US010041697B1

(12) United States Patent
Black

(10) Patent No.: US 10,041,697 B1
(45) Date of Patent: Aug. 7, 2018

(54) NOISE REDUCTION SYSTEM FOR IN-WALL HVAC SYSTEMS

(71) Applicant: Parnell Black, Huntington Beach, CA (US)

(72) Inventor: Parnell Black, Huntington Beach, CA (US)

( * ) Notice: Subject to any disclaimer, the term of this patent is extended or adjusted under 35 U.S.C. 154(b) by 133 days.

(21) Appl. No.: 14/885,964

(22) Filed: Oct. 16, 2015

(51) Int. Cl.

| | |
|---|---|
| ***F24F 13/24*** | (2006.01) |
| ***G10K 11/16*** | (2006.01) |
| ***F24F 13/02*** | (2006.01) |
| ***G10K 11/178*** | (2006.01) |
| ***G10K 11/162*** | (2006.01) |
| *G10K 11/00* | (2006.01) |

(52) U.S. Cl.
CPC ..... *F24F 13/24* (2013.01); *F24F 13/0227* (2013.01); *G10K 11/161* (2013.01); *G10K 11/162* (2013.01); *G10K 11/178* (2013.01); *F24F 2013/242* (2013.01); *F24F 2013/247* (2013.01); *G10K 2210/112* (2013.01)

(58) Field of Classification Search
CPC .. F24F 13/24; F24F 13/0227; F24F 2013/242; F24F 2013/247; G10K 11/161; G10K 11/178; G10K 2210/112
USPC ..... 181/224, 225
See application file for complete search history.

(56) References Cited

U.S. PATENT DOCUMENTS 1,938,800 A * 12/1933 Bourne ..... F16L 55/02 454/206
2,270,825 A * 1/1942 Parkinson ..... G10K 11/161 181/224
2,704,504 A * 3/1955 Wilkening ..... E06B 7/02 181/224
3,789,747 A * 2/1974 Wasserman ..... F24F 7/08 454/186
3,841,434 A * 10/1974 Culpepper, Jr. ..... F01N 1/24 126/299 D
3,963,094 A * 6/1976 Nowikas ..... E04B 1/8218 181/198
4,050,364 A * 9/1977 Maus ..... E06B 7/02 181/224
4,660,676 A * 4/1987 Eustace ..... F24F 13/24 181/224
5,076,152 A * 12/1991 Muller ..... F24F 7/08 454/245
5,636,286 A * 6/1997 Makabe ..... G10K 11/1788 181/216
5,851,144 A * 12/1998 Nystrom ..... F24F 13/06 454/306
5,983,888 A * 11/1999 Anselmino ..... F04D 29/664 126/299 D (Continued)

*Primary Examiner* — Edgardo San Martin
(74) *Attorney, Agent, or Firm* — Apogee Law Group P.C.

(57) ABSTRACT

This invention provides a noise reduction system for in-wall HVAC systems. The noise reduction system can be constructed as a box structure that can be attached to an exterior wall of a dwelling where the box structure overlaps the intake air vent and the exhaust air vent of the in-wall HVAC system. For new or remodeled construction, the noise reduction system may be built into the dwelling's exterior wall so that the amount of noise reduction system's protrusion beyond the flat surface of the exterior wall is minimized. For additional noise reduction, the noise reduction system can incorporate active and/or passive noise reduction features.

44 Claims, 10 Drawing Sheets

(56) References Cited

U.S. PATENT DOCUMENTS

| | | | | |
|---|---|---|---|---|
| 6,342,005 | B1 * | 1/2002 | Daniels | F24F 13/24 181/224 |
| 6,370,899 | B1 * | 4/2002 | Hobbs | F24F 13/20 62/259.1 |
| 6,370,906 | B1 * | 4/2002 | Kuo | F24F 13/06 454/245 |
| 7,549,505 | B1 * | 6/2009 | Kawar | G06F 1/18 181/202 |
| 7,980,357 | B2 * | 7/2011 | Edwards | F01D 25/30 181/264 |
| 8,336,672 | B2 * | 12/2012 | Derks | F16L 55/033 181/224 |
| 8,540,557 | B1 * | 9/2013 | Derks | F24F 13/24 454/184 |
| 2007/0125592 | A1 * | 6/2007 | Michell | F16L 55/0333 181/206 |
| 2009/0133957 | A1 * | 5/2009 | Owens | F24F 13/24 181/224 |
| 2015/0101883 | A1 * | 4/2015 | Xu | F24F 13/082 181/224 |
| 2016/0066699 | A1 * | 3/2016 | Rydsund | G10K 11/161 5/53.1 |

* cited by examiner

NOISE REDUCTION SYSTEM FOR IN-WALL HVAC SYSTEMS

BACKGROUND OF THE INVENTION

1. Field of the Invention

This invention provides an noise reduction system for in-wall or through wall Heating, Ventilation and Air Conditioning ("HVAC") systems.

2. Related Art

Today's Heating, Ventilation and Air Conditioning ("HVAC") systems typically have one or more compressors for compressing and pumping refrigerants as part of the conditioning and cooling of the air that is circulated inside of a building. The compressors and air handling systems can often create substantial noise during start-up and operation. In many instances the compressors and air handling motors are positioned adjacent to or within exterior walls of dwellings. With many communities experiencing close proximity between neighbors, the HVAC system for a dwelling can create substantial noise issues for that dwelling's neighbors. Increasingly, communities are enacting noise limitations for HVAC systems and empowering their enforcement officers to police the sound levels of HVAC systems to prevent these noise issues from developing between neighbors.

Accordingly, noise generated by the condensing unit as a whole may undesirably be perceived by persons within the building, outdoors, and/or in other buildings. One way to reduce the noise levels of HVAC systems is to employ variable speed systems. The replacement of single speed HVAC units with variable speed units has resulted in both efficiency improvements as well as reductions in noise generated by the HVAC systems. However, even variable speed HVAC units at times run at full operation and generate substantial noise.

Another source of unwanted noise is high velocity air movements. In some prior art systems, a baffle comprising perforated sheet metal is positioned within the air duct for the inlet or outlet of the fan coil. The perforations in the sheet metal allow air traveling through the baffle to interact with the insulation material contained inside the baffle. Such a configuration acts to attenuate the noise generated by the fan coil.

However, prior art systems fail to adequately reduce the noise pressure levels to an acceptable level. Thus, a need exists to provide a low cost solution to reduce noise levels emanating from HVAC systems in certain environments such as residential neighborhoods.

SUMMARY

This invention provides a noise reduction system for in-wall HVAC systems. The noise reduction system can be attached to the exterior wall of a dwelling encompassing the intake air and exhaust air vents of the HVAC system. A housing structure may be mounted on the dwelling's exterior wall to overlap the intake air vent and the exhaust air vent of the in-wall HVAC system. Within the housing, the noise reduction system comprises at least two chambers. A first chamber for intake air and the second chamber for exhaust air. Ideally, the noise reduction system's opening for intake air in the first chamber is spaced from the opening for exhaust air in the second chamber. For additional noise reduction, the chambers of the noise reduction system can incorporate active and passive noise reduction features.

For new or remodeled construction, the noise reduction system may be built within the interior space of the exterior wall of the dwelling so that the noise reduction system is integrated within the dwelling's exterior wall so that the noise reduction system's openings are essentially flush with exterior wall of the dwelling. The noise reduction system comprises at least two chambers. A first chamber is for intake air and the second chamber for exhaust air. Ideally, the noise reduction system's opening for intake air in the first chamber is spaced from the opening for exhaust air in the second chamber. For additional noise reduction, the chambers of the noise reduction system can incorporate active and passive noise reduction features. A chimney structure may also be configured and attached to the exterior wall of a dwelling to camouflage the noise reduction system within the chimney structure.

Other systems, methods, features, and advantages of the invention will be or will become apparent to one with skill in the art upon examination of the following figures and detailed description. It is intended that all such additional systems, methods, features and advantages be included within this description, be within the scope of the invention, and be protected by the accompanying claims.

DETAILED DESCRIPTION OF THE DRAWINGS

The components in the figures are not necessarily to scale, emphasis being placed instead upon illustrating the principles of the invention. In the figures, like reference numerals designate corresponding parts throughout the different views.

DETAILED DESCRIPTION

All in-wall Heating, Ventilation and Air Conditioning ("HVAC") systems have an air inlet and air outlet vent on the exterior side wall of a dwelling. In-wall HVAC systems are known to produce a significant amount of noise due to the noise of the compressor, fan(s) and the high frequency noise generated by the movement of air through the condensing coil. To address the noise coming from in-wall HVAC systems, a box can be constructed around the air inlet and exhaust air vents of the in-wall HVAC system with one side open or partially opened thus creating a cavity to capture the noise generated by the in-wall HVAC system. Since in-wall HVAC systems are typically mounted and positioned along an exterior wall of the dwelling being cooled and away from interfering structures such as windows, stairs and chimneys, the noise reduction box structure can be made to fit over the HVAC unit's air inlet and exhaust vents that are exposed on the exterior wall of the dwelling.

The noise reduction system can be attached to the exterior wall of a dwelling where the noise reduction housing structure mounts on the dwelling's exterior wall and overlaps the intake air vent and the exhaust air vent of the in-wall HVAC system. Within the housing, the noise reduction system comprises at least two chambers. A first chamber for intake air and the second chamber for exhaust air. Ideally, the noise reduction system's opening for intake air in the first chamber is spaced from the opening for exhaust air in the second chamber. For additional noise reduction, the chambers of the noise reduction system can incorporate active and passive noise reduction features.

For new or remodeled construction, the noise reduction system may be built within the interior space of the exterior wall of the dwelling so that the noise reduction system is integrated within the dwelling's exterior wall so that the noise reduction system's openings are essentially flush with exterior wall of the dwelling. The noise reduction system comprises at least two chambers. A first chamber is for intake air and the second chamber for exhaust air. Ideally, the noise reduction system's opening for intake air in the first chamber is spaced from the opening for exhaust air in the second chamber. For additional noise reduction, the chambers of the noise reduction system can incorporate active and passive noise reduction features.

A hybrid system can also be formed so that the noise reduction system is partially integrated into the exterior wall and part of the noise reduction system extrudes and extends beyond the flat surface of the exterior wall.

Figure 1:
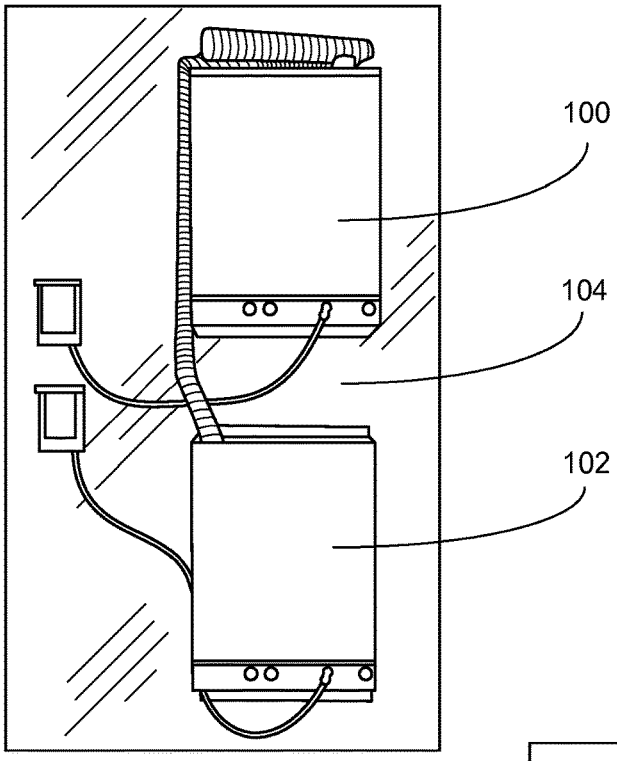
FIG. 1 is a front view of an in-wall HVAC system from the perspective of the interior of a dwelling.

FIG. 1 is a front view of an in-wall HVAC system from the perspective of the interior of a dwelling. In FIG. 1, two in-wall HVAC units 100 and 102 are shown positioned one on top of each other with a small area of separation 104. The in-wall HVAC unit 100 covers zone one and the in-wall HVAC unit 102 covers zone two of a dwelling. It is conceivable that a single zone in-wall HVAC unit could be installed to cool a dwelling as well.

Figure 2:
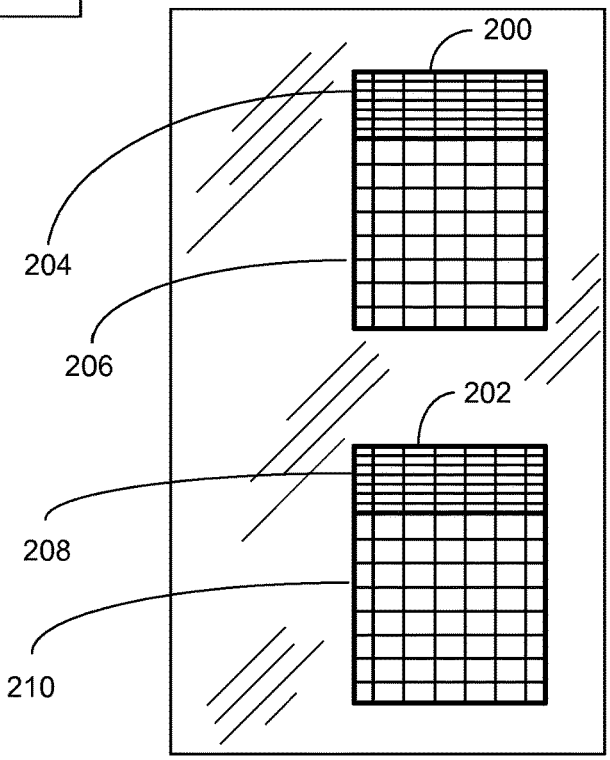
FIG. 2 is a front view of the vent structures extruding from the exterior of a dwelling for two zone in-wall HVAC systems.

FIG. 2 is a front view of the vent structures extruding from the exterior of a dwelling for two zone in-wall HVAC systems. The in-wall HVAC unit 200 for the first zone may be positioned on top of the second in-wall HVAC unit 202 for the second zone as shown in FIG. 1. In some situations, the HVAC manufacturers may recommend that the installation of two HVAC systems be positioned side-by-side with minimum spacing of approximately six (6) feet. Such side-by-side positioning and minimum spacing is to facilitate with keeping the exhaust air from becoming the intake air thus negatively affecting the HVAC systems' efficiency. The exhaust air 204 section is positioned above the intake air section 206 of the first zone in-wall HVAC system. Likewise, the exhaust air section 208 section is positioned above the intake air section 210 of the second zone in-wall HVAC system. While positioning the exhaust air section 208 adjacent to the intake air section 206 makes for a cleaner, easier to install system, a certain amount of efficiency is lost as the hotter exhaust air is easily pulled into the intake air section 206.

Figure 3:
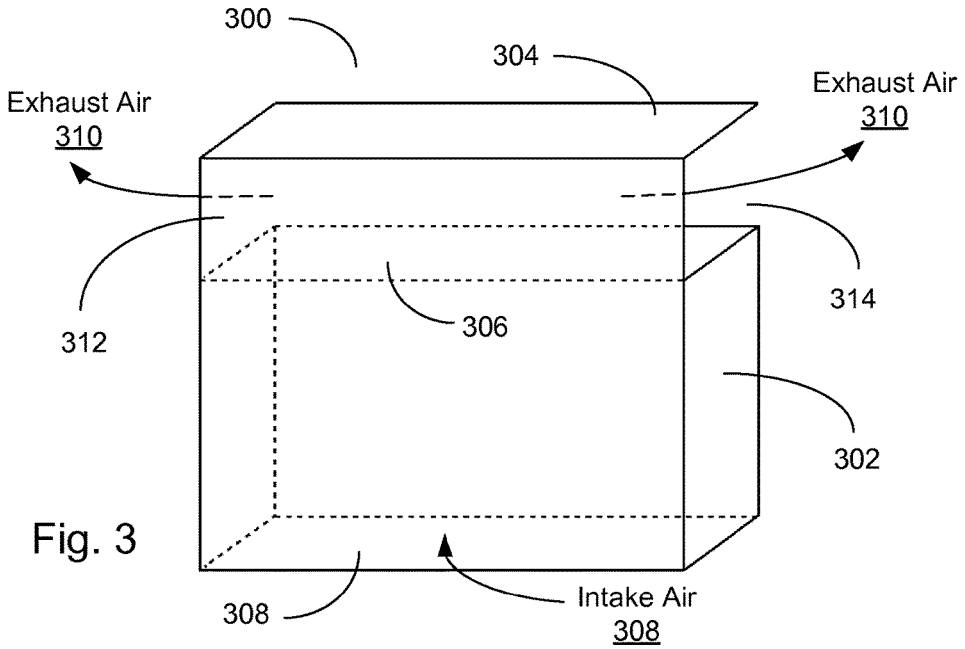
FIG. 3 is a cut-away perspective view of a noise reduction system for lowering the sound pressure levels of HVAC systems.

FIG. 3 is a cut-away perspective view of an in-wall noise reduction system for lowering the sound pressure levels of HVAC system. One of the problems associated with in-wall HVAC systems positioned on the side of a dwelling in high density urban areas or in neighborhoods with close spacing between the dwellings is that noisy HVAC systems can radiate noise outwards from the HVAC systems' intake and exhaust air vents. In these instances, the noise generated by the in-wall HVAC systems can radiate from one dwelling into adjacent dwellings causing problems with the neighbors or in some instance become violations of community noise abatement standards leading to the receipt of city citations.

Another concern associated with the positioning of the intake air and exhaust air vents shown in FIGS. 1 and 2, is the chance that air blockages and air flow restrictions that may reduce efficiency of the HVAC systems from the positioning of external structures such as fences or the improper positioning a resident's personal effects such as patio umbrellas or other personal effects that may be stored in or around the air vents. In almost all in-wall HVAC units, the side of the HVAC unit that is exposed to the outside environment of the dwelling sits flush to the dwelling's exterior wall as shown in FIG. 2. Because the HVAC unit is separated into two compartments, namely the intake and exhaust air vents, any noise reduction system should be constructed so that it does not restrict the intake air flow into or the exhaust air out of the HVAC unit.

A box housing structure 300 can be positioned around the HVAC intake air and exhaust air vents with a first lower chamber 302 and a second upper chamber 304 with a separation wall 306 positioned separating the first and second chambers 302 and 304 within the box structure 300. The intake air vent 308 can be positioned anywhere in the first chamber 302. In this embodiment, the intake air vent 308 is positioned in the bottom part of the first chamber 302 so that the intake air vent 308 does not interfere with the exhaust air 310.

For the embodiment in FIG. 3, exhaust air 310 can exit the box 300 through the exhaust air openings 312 and 314 positioned on the sides of the second chamber 304 above the separation wall 306. In another embodiment, the exhaust air could exit from the top of the second chamber 304. One of the disadvantages of a top opening exhaust air vent is that rain can enter the exhaust air vent of the HVAC system. Also, an intake air opening 308 can be located on the bottom wall of the first chamber 302 of the box 300 to allow unobstructed air to flow into the intake air vent 308 or the intake air opening 308 could be positioned into the sides of the first chamber 302.

The air circulation restrictions with an upper side opening exhaust air openings 312 and 314 with a bottom section intake air opening 308 can help improve the HVAC's efficiency as there is a lower probability of warmer (hot) exhaust air from flowing immediately back into the cooler intake air vent shown in FIG. 2. In addition to reducing the noise from the HVAC system, the noise reduction system facilitates the separation of cooler intake air from the warmer exhaust air thus improving HVAC efficiency.

The upper compartment is segregated for the exhaust air and can be ventilated from either the left side 312 and/or the right side 314 of the box 300. In some instances such as when there is a desire to reduce the noise propagating to the front of a dwelling, the exhaust air may be limited so as to only be expelled through an opening in the box 300 positioned so that the air is diverted towards the rear of the dwelling. Depending upon which exterior wall of the dwelling where the HVAC system is located, either the left side 312 or the right side 314 of the noise reduction system would be open. Such a configuration is shown in FIG. 5.

Figure 4:
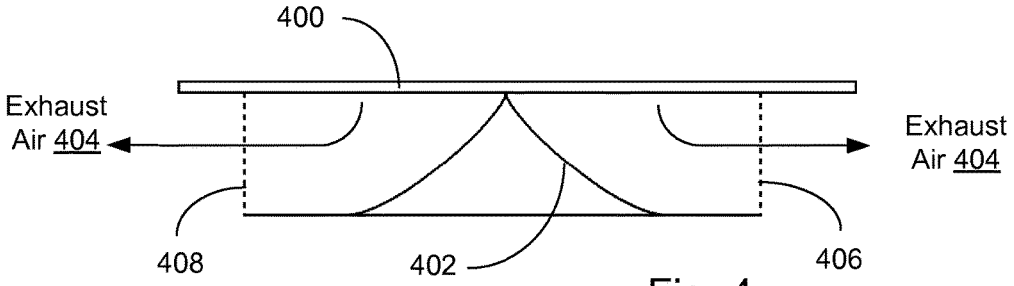
FIG. 4 is a top view of a two way diverter positioned within the second chamber of the HVAC noise reduction system.

FIG. 4 is a top view of a two way diverter positioned within the second chamber 304 of the in-wall HVAC noise reduction system 400. Within the second chamber 304, a "V" shaped structure 402 may be positioned to help divert the exhaust air 404 and facilitate dispersing the exhaust air 404 approximately equally to the left and right of the second chamber 304 box through the vents 406 and 408 on either side of the chamber. To accomplish this, the "V" shaped structure 402 may be formed to have curved walls to ease the transitions and reduce turbulence. Such an air diversion structure 402 made of wood, sheet metal and/or plastic with the center point of the "V" approximately aligned in the center of the chamber 304.

Figure 5:
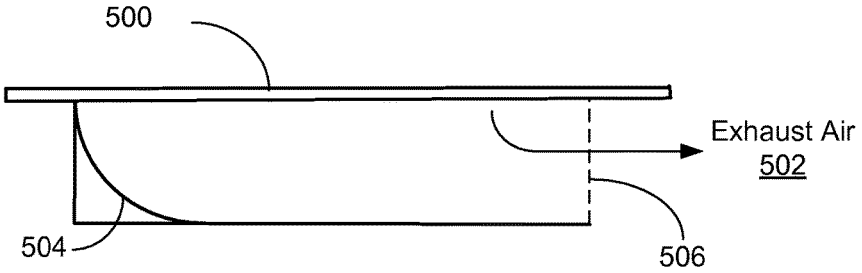
FIG. 5 is a top view of a one way diverter positioned within the second chamber of the HVAC noise reduction system.

FIG. 5 is a top view of a one way diverter positioned within the second chamber of the HVAC noise reduction system 500. In some scenarios, it is not practical or maybe not desirable to direct the exhaust air flow 502. In this embodiment, at least one exhaust air vent 506 is constructed in the second chamber and a diverter 504 is positioned within the second chamber to facilitate directing the exhaust air out the exhaust air vent 506 so that a minimum of turbulence is created as the exhaust air 502 is expelled out of the second chamber.

For the noise reduction system, wood may be a suitable construction material due to its visual appeal and formed as an appendage to a dwellings a visually attractive design is desirable to the resale of the dwelling. Wood also has excellent sound dampening properties. For rugged endurance, ½ or ¾ inch plywood laminate materials may be used. Any type of wood could be used for the construction, but durability should be of concern and should be incorporated into the design of the noise reduction system. As an alternative embodiment, the noise reduction system could be constructed of a composite of metal, plastic, manufactured wood products/composite products and/or natural wood. Composite wood products are typically a material that comprises a mixture of wood fiber, plastic and some type of binding agents that when put together for a material that is denser, stronger and heavier than wood alone. Formed of composite wood products, metal and/or plastic the outer housing shell may make the noise reduction system a long lasting durable frame structure while allowing a wood product for the housing's sides to provide excellent sound dampening properties.

Ultimately, the goal is to suppress the noise created by the HVAC system by reducing the sound pressure levels to an acceptable decibel level or directing the noise in a direction that provides the minimum impact on third parties. The noise reduction system should also be aesthetically pleasing it is to prevent reduction in value of the dwelling or to run afoul of other dwelling restrictions based on the dwelling's community rules and regulations.

Figure 6:
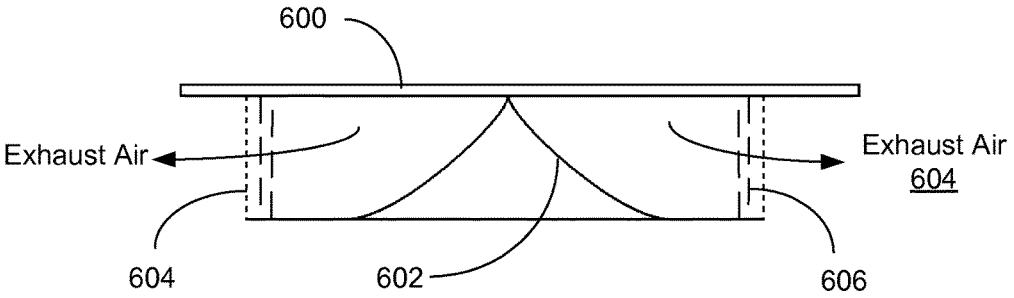
FIG. 6 is a top cross sectional view of a two way diverter positioned within the HVAC noise reduction system with a noise muffler system.

FIG. 6 is a top cross sectional view of a two way diverter positioned within the second chamber of the in-wall HVAC noise reduction system 600. Within the second chamber, a "V" shaped structure 602 may be positioned to help divert the exhaust air 604 and facilitate dispersing the exhaust air 604 approximately equally to the left and right of the second chamber box through the vents on either side of the chamber. To accomplish this, the "V" shaped structure 602 may be formed to have curved walls to ease the transitions and reduce air flow turbulence. Such an air diversion structure 602 made of wood, sheet metal and/or plastic with the center point of the "V" approximately aligned in the center of the second chamber. In this embodiment, a noise reduction muffler 606 can be incorporated into the second chamber. A noise reduction muffler 606 may comprise at least one slotted member or may incorporate some other noise reduction material to passively reduce the amount of noise coming from the exhaust air vent 604 and the HVAC system.

Figure 7:
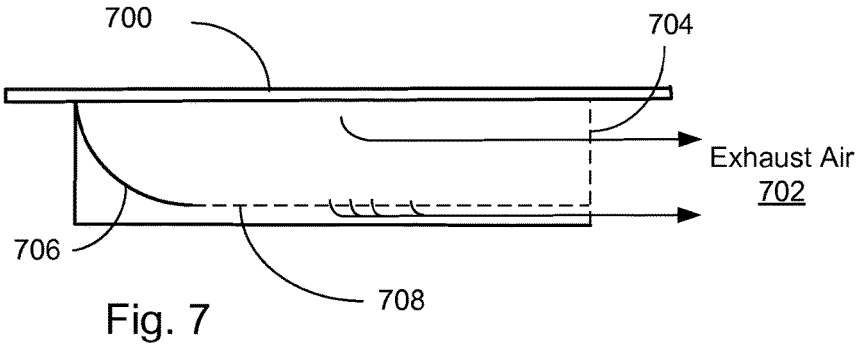
FIG. 7 is a top cross sectional view of a one way diverter positioned within the second chamber of the HVAC noise reduction system with a noise muffler system.

FIG. 7 is a top cross sectional view of a one way diverter positioned within the second chamber of the HVAC noise reduction system 700. In some scenarios, it is not practical or maybe not desirable to direct the exhaust air flow 702. In this embodiment, at least one exhaust air vent 704 is constructed in the second chamber and a diverter 706 is positioned within the second chamber to facilitate directing the exhaust air out the exhaust air vent 704 so that a minimum of turbulence is created as the exhaust air 702 is expelled out of the second chamber. A muffler system 708 can also be incorporated into the noise reduction system 700 to further reduce the noise from the exhaust air 702 and the HVAC noise. A noise reduction muffler 708 may comprise at least one slotted member or other noise reduction material to further reduce the amount of noise coming from the exhaust air vent 704 and the HVAC system. Other muffler systems can be incorporated that are well known in the art including ones that can be tuned to optimize the best noise reduction.

Figure 8:
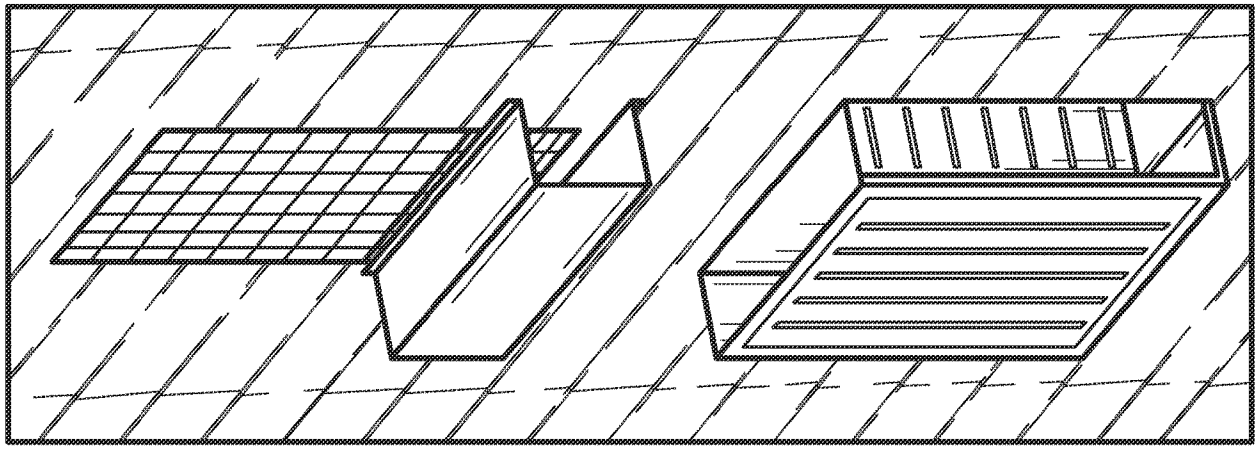
FIG. 8 is a perspective view of a first embodiment of an in-wall noise reduction system for lowering the sound pressure levels of HVAC systems' of intake air and exhaust air.
Figure 9:
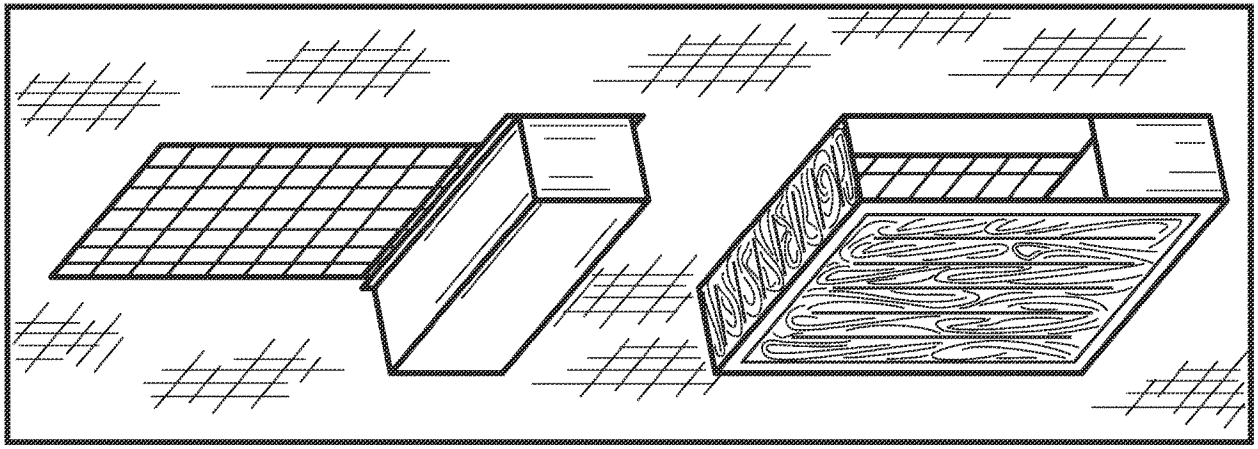
FIG. 9 is a perspective view of a second embodiment of an in-wall noise reduction system for lowering the sound pressure levels of HVAC systems' intake air and exhaust air.

FIGS. 8 and 9 illustrate an exterior, noise reduction system mounted on a dwelling's exterior wall. FIG. 8 is a perspective view of an in-wall noise reduction system for lowering the sound pressure levels of HVAC systems' intake air and exhaust air. FIG. 8 illustrates a two unit HVAC system, a first HVAC system positioned above a second HVAC system. A noise reduction system in the form of a box structure is shown. The bottom of the exterior box structure provides an opening in the bottom chamber of the box for the intake air for the HVAC system. The opening at the top of the box is for the upper chamber and allows for the exhaust air to exit the noise reduction system box.

In FIG. 8, the upper zone HVAC system is shown with the noise reduction system housing mounted to the side of the exterior wall of the dwelling. The intake air enters through the bottom of the housing of the noise reduction system while the exhaust air is expelled through openings in the left and right (not shown) upper side of the noise reduction system's housing. The lower zone of the HVAC system shows the noise reduction system housing removed. In its simplest form, the second chamber for the exhaust air is formed by a sheet metal flashing that forms a box with its ends open. These openings provide the exit vent for the exhaust air to leave the noise reduction system. As shown in FIG. 8, the intake air is on the bottom of the housing while the exhaust air is vented through vent openings that are spaced apart from each other when compared to how close the openings are in FIG. 2.

FIG. 9 is a perspective view of an in-wall noise reduction system for lowering the sound pressure levels of HVAC systems' intake air and exhaust air. In this embodiment, the opening in the lower chamber is positioned in the left side of the box structure. The exhaust air exit is vented out the right side of the upper chamber (not shown). In FIG. 9, the intake air enters through the left and/or right side (not shown) of the first chamber of the noise reduction system housing. The air exhaust could be configured to also be vented out of the sides of the upper chamber, but for better efficiency, the exhaust air should be vented out the top of the noise reduction system housing. Thus, in the lower part of FIG. 9, the sheet metal forming the second chamber for the exhaust air is closed on all sides except for the top surface.

In some embodiments the noise reduction system may be built directly into the wall. The embodiment could possibly extend beyond the exterior surface of the wall so that it intrudes beyond the dwelling's exterior wall. However, in most applications, the noise reduction system is positioned flat with the exterior surface of the dwelling's wall. Typically, the standard wall thickness of a dwelling's wall does not provide the space for the noise reduction system. Thus, it may be optimal to extend within the dwelling's exterior wall. In such configurations, the HVAC system is then mounted to the interior surface of the noise reduction system so that the HVAC system's intake air and exhaust air mate up to the in-wall noise reduction system.

Also within the in-wall noise reduction system, a plurality of vanes can be positioned to muffle the noise of the HVAC system and the air movement. These vanes may be constructed of wood, plastic or metal and may have an integrated noise reduction material attached to the vanes or constructed so that there is a minimum of turbulence created by the vanes to thus reduce air movement noise.

The HVAC noise and the noise generated by air movement typically creates a white noise environment. An active notice cancellation system may also be employed within the in-wall noise reduction system so that a microphone detects the frequencies of the HVAC noise and the noise generated by the air movement, the noise detected by the microphones is analyzed by a digital signal processor and cancellation frequencies are generated and passed to at least one transducers so that the HVAC noise and noise created by the air movement is cancelled thus reducing the sound pressure levels of the HVAC systems' operation.

Likewise, passive noise cancellation methodologies can be employed to reduce the sound pressure levels when the HVAC system is in operation by the use of noise absorbing materials such as insulation, sound absorbing materials or creating a muffler system within the noise reduction system.

In some embodiments the noise reduction system may be built directly into the wall. The embodiment could possibly extend beyond the exterior surface of the wall so that it intrudes beyond the dwelling's exterior wall. However, in most applications, the noise reduction system is positioned flat with the exterior surface of the dwelling's wall. Typically, the standard wall thickness of a dwelling's wall does not provide the space for the noise reduction system. Thus, it may be optimal to extend within the dwelling's exterior wall. In such configurations, the HVAC system is then mounted to the interior surface of the noise reduction system so that the HVAC system's intake air and exhaust air vent mate up to the in-wall noise reduction system so that bleed air is not generated.

Also within the in-wall noise reduction system, a plurality of vanes can be positioned to muffle the noise of the HVAC system and the air movement. These vanes may be constructed of wood, plastic or metal and may have an integrated noise reduction material attached to the vanes or constructed so that there is a minimum of turbulence created by the vanes to thus reduce air movement noise.

Figure 10:
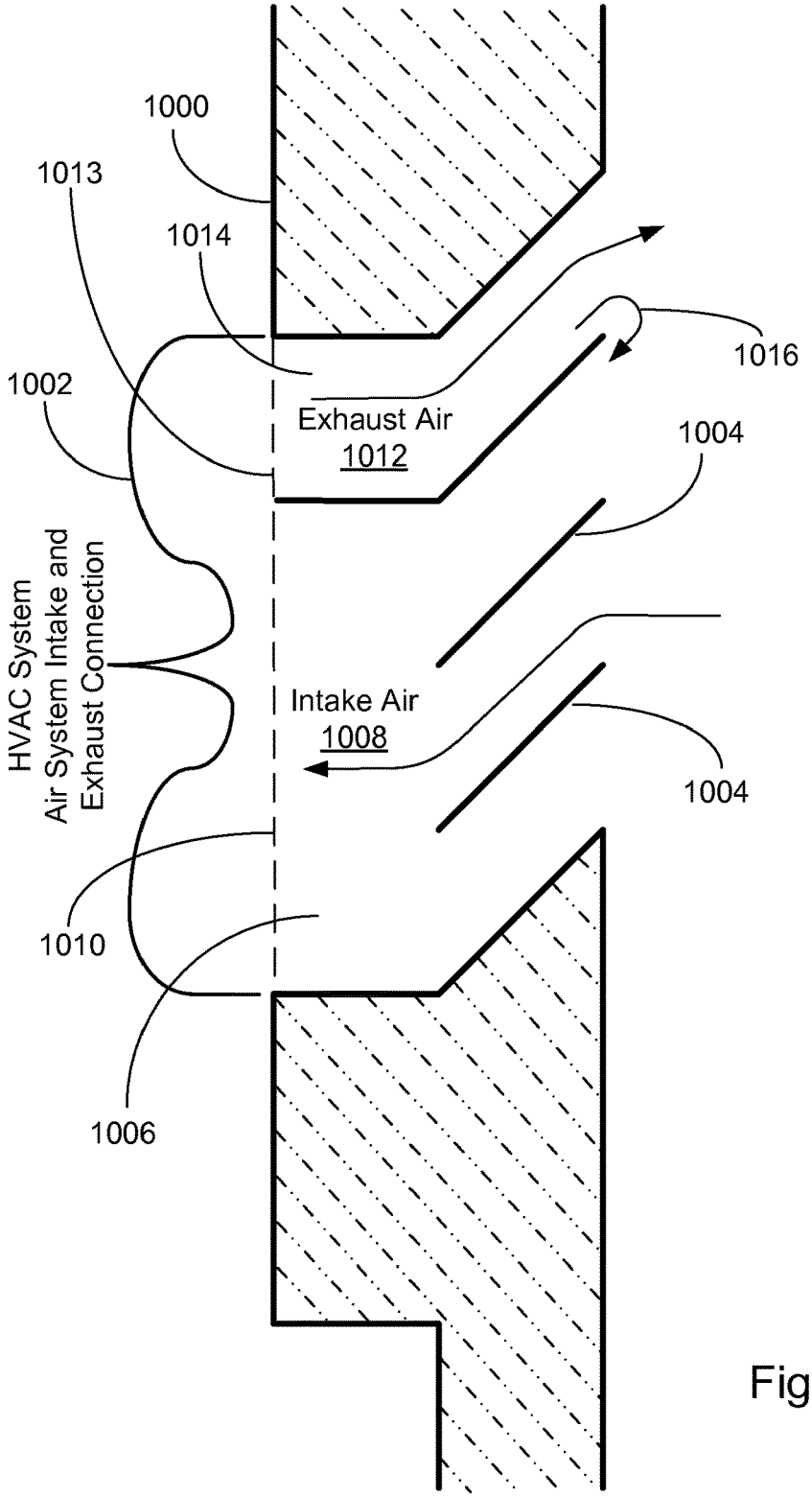
FIG. 10 is a side cut away view of a first embodiment of a cross section of an in-wall noise reduction system built into the wall of a dwelling.

FIG. 10 is a side cut away view of a first embodiment of a cross section of an in-wall noise reduction system built into the wall of a dwelling. The in-wall noise reduction system is positioned within the exterior wall 1000 of the dwelling on one side and the in-wall HVAC system 1002 connected on a second side. A plurality of vanes 1004 are positioned inside a first chamber 1006 within the exterior wall 1000 so that the intake air 1008 can be brought into the dwelling and passed to the HVAC's system's intake air vent 1010. Likewise, exhaust air 1012 from the HVAC system's exhaust air vent 1013 can be directed in a second chamber 1014 and directed to the exterior of the dwelling. In such a configuration, the noise generated by the HVAC system 1002 and the noise generated by the air movement can be directed upward and away from the front of the dwelling or the neighbor's dwelling.

However, this embodiment has several short comings. First, the exhaust air 1012 can readily be pulled back into 1016 the intake air and mixed with the intake air 1008. As the hot exhaust air 1012 is readily sucked back in and mixed with the intake air 1008, the decreased operating efficiency of the HVAC system 1002 may not offset the noise reduction achieved by the in-wall noise reduction system.

Figure 11:
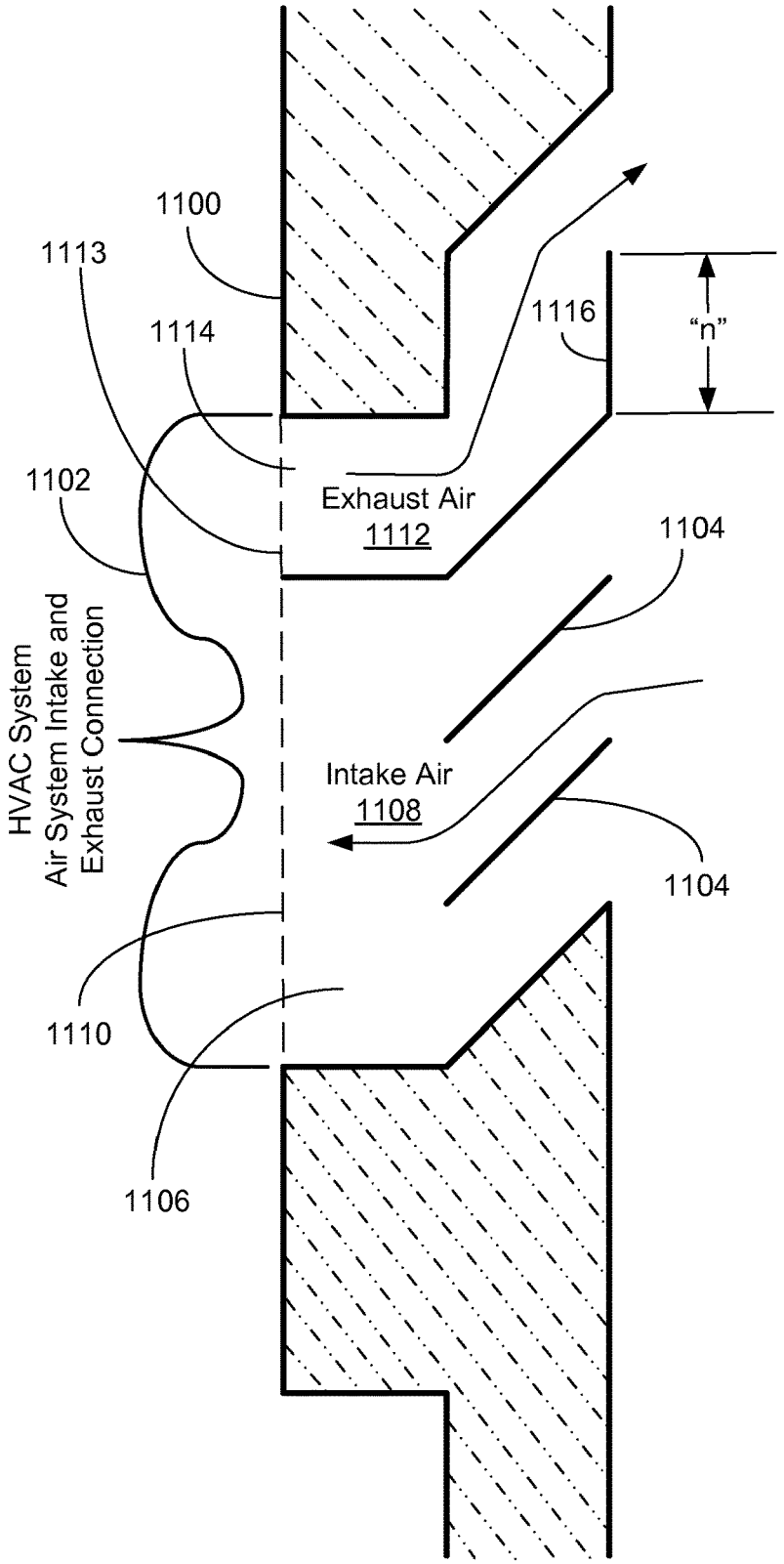
FIG. 11 is a side cut away view of a second embodiment of a cross section of an in-wall noise reduction system built into the wall of a dwelling.

FIG. 11 is a side cut away view of a second embodiment of a cross section of an in-wall noise reduction system built into the wall of a dwelling. The in-wall noise reduction system is positioned within the exterior wall 1100 of the dwelling on one side and the in-wall HVAC system 1102 connected on a second side. A plurality of vanes 1104 are positioned inside a first chamber 1106 within the exterior wall 1100 so that intake air 1108 can be brought into the dwelling and passed to the HVAC's system's intake air vent 1110. Likewise, exhaust air 1112 from the HVAC system's exhaust air vent 1113 can be directed in a second chamber 1114 and directed to the exterior of the dwelling. In such a configuration, the noise generated by the HVAC system 1102 and the noise generated by the air movement can be directed upward and away from the front of the dwelling or the neighbor's dwelling.

In this embodiment shown in FIG. 11, a spacer 1116 is positioned so that the exhaust air 1112 is separated by a distance n" from the intake air 1108. The distance "n" can be any distance, but typically is long enough so that the exhaust air 1112 is not pulled back into the intake air vent 1110.

Figure 12:
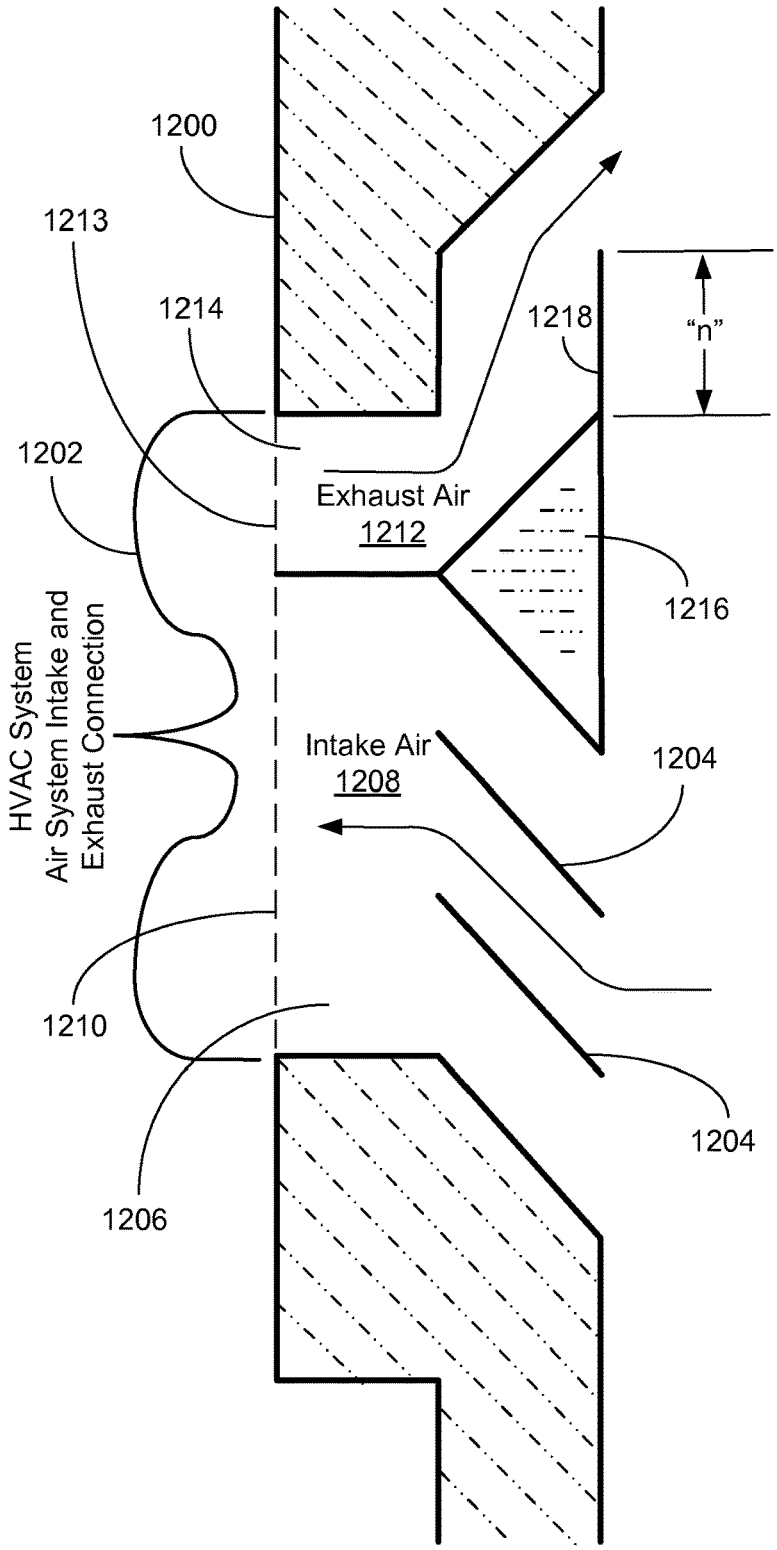
FIG. 12 is a side cut away view of a third embodiment of a cross section of an in-wall noise reduction system built into the wall of a dwelling.

FIG. 12 is a side cut away view of a third embodiment of a cross section of an in-wall noise reduction system built into the wall of a dwelling. The in-wall noise reduction system is positioned within the exterior wall 1200 of the dwelling on one side and the in-wall HVAC system 1202 connected on a second side. A plurality of vanes 1204 are positioned inside a first chamber 1206 within the exterior wall 1200 so that intake air 1208 can be brought into the dwelling and passed to the HVAC's system's intake air vent 1210. Likewise, exhaust air 1212 from the HVAC system's exhaust air vent 1213 can be directed in a second chamber 1214 and directed to the exterior of the dwelling. In such a configuration, the noise generated by the HVAC system 1202 and the noise generated by the air movement can be directed upward and away from the front of the dwelling or the neighbor's dwelling.

In the embodiment shown in FIG. 12, a diverter 1216 is positioned so that the exhaust air 1212 is diverted upwards and away from the intake air 1208. In this embodiment, the vanes 1204 are angled such that the intake air is pulled from a lower point and up into the intake air vent 1210. Also, a spacer 1218 can be positioned on top of the diverter 1216 by a distance n" from the intake air 1208. The distance "n" can be any distance, but typically is long enough so that the exhaust air 1212 is not pulled back into the intake air vent 1210.

Figure 13:
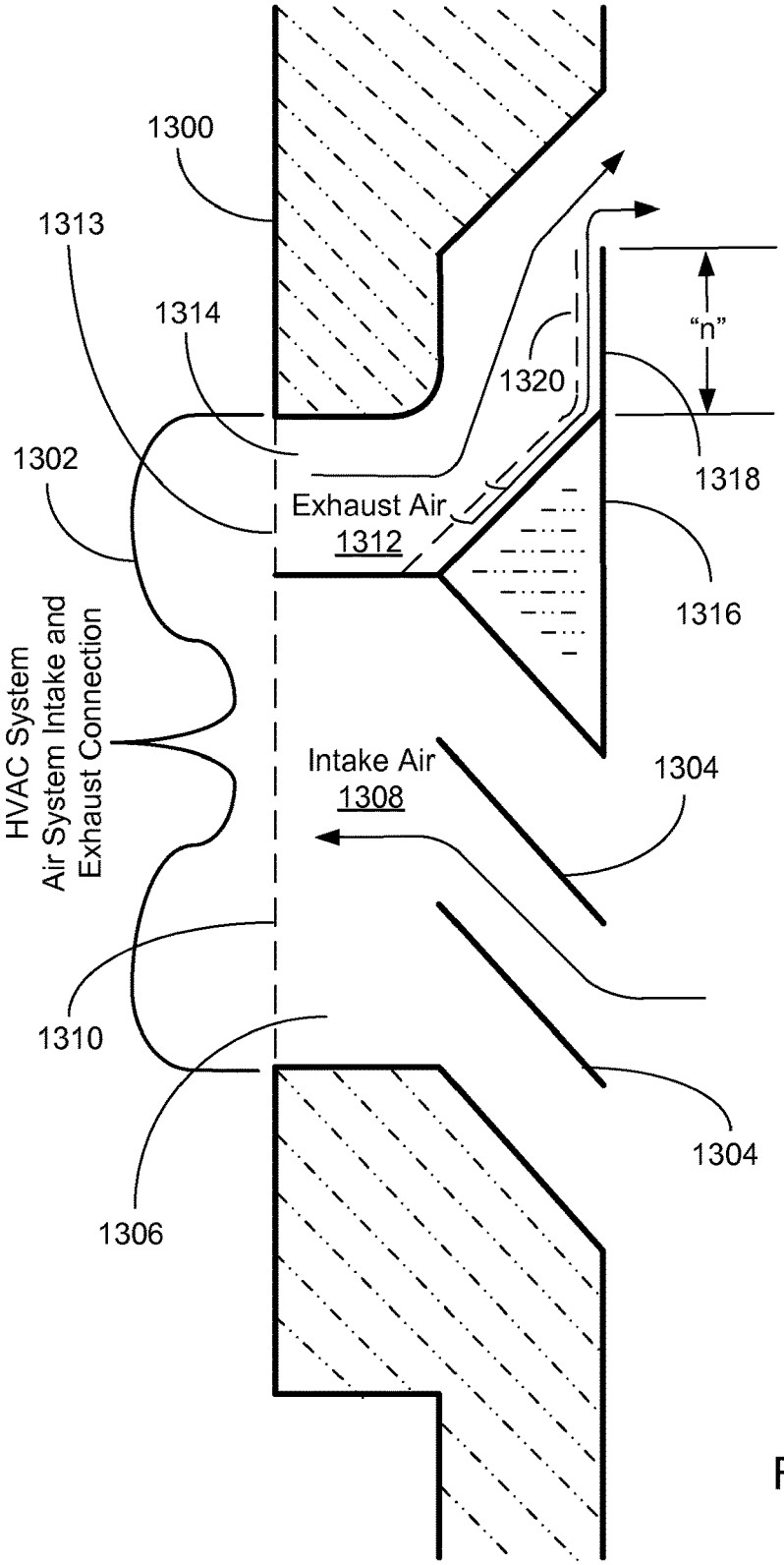
FIG. 13 is a side cut away view of a fourth embodiment of a cross section of an in-wall noise reduction system built into the wall of a dwelling.

FIG. 13 is a side cut away view of a fourth embodiment of a cross section of an in-wall noise reduction system built into the wall of a dwelling. The in-wall noise reduction system is positioned within the exterior wall 1300 of the dwelling on one side and the in-wall HVAC system 1302 connected on a second side. A plurality of vanes 1304 are positioned inside a first chamber 1306 within the exterior wall 1300 so that intake air 1308 can be brought into the dwelling and passed to the HVAC's system's intake air vent 1310. Likewise, exhaust air 1312 from the HVAC system's exhaust air vent 1313 can be directed in a second chamber 1314 and directed to the exterior of the dwelling. In such a configuration, the noise generated by the HVAC system 1302 and the noise generated by the air movement can be directed upward and away from the front of the dwelling or the neighbor's dwelling.

In the embodiment shown in FIG. 13, a diverter 1316 is positioned so that the exhaust air 1312 is diverted upwards and away from the intake air 1308. In this embodiment, the vanes 1304 are angled such that the intake air is pulled from a lower point and up into the intake air vent 1310. Also, a spacer 1318 can be positioned on top of the diverter 1316 by a distance n" from the intake air 1308. The distance "n" can be any distance, but typically is long enough so that the exhaust air 1312 is not pulled back into the intake air vent 1310. In this embodiment, a muffler system 1320 is added providing further noise reduction by the insertion of a slotted duct into the exhaust air chamber 1314. Other muffler systems can be incorporated that are well known in the art including ones that can be tuned to optimize the best noise reduction.

Figure 14:
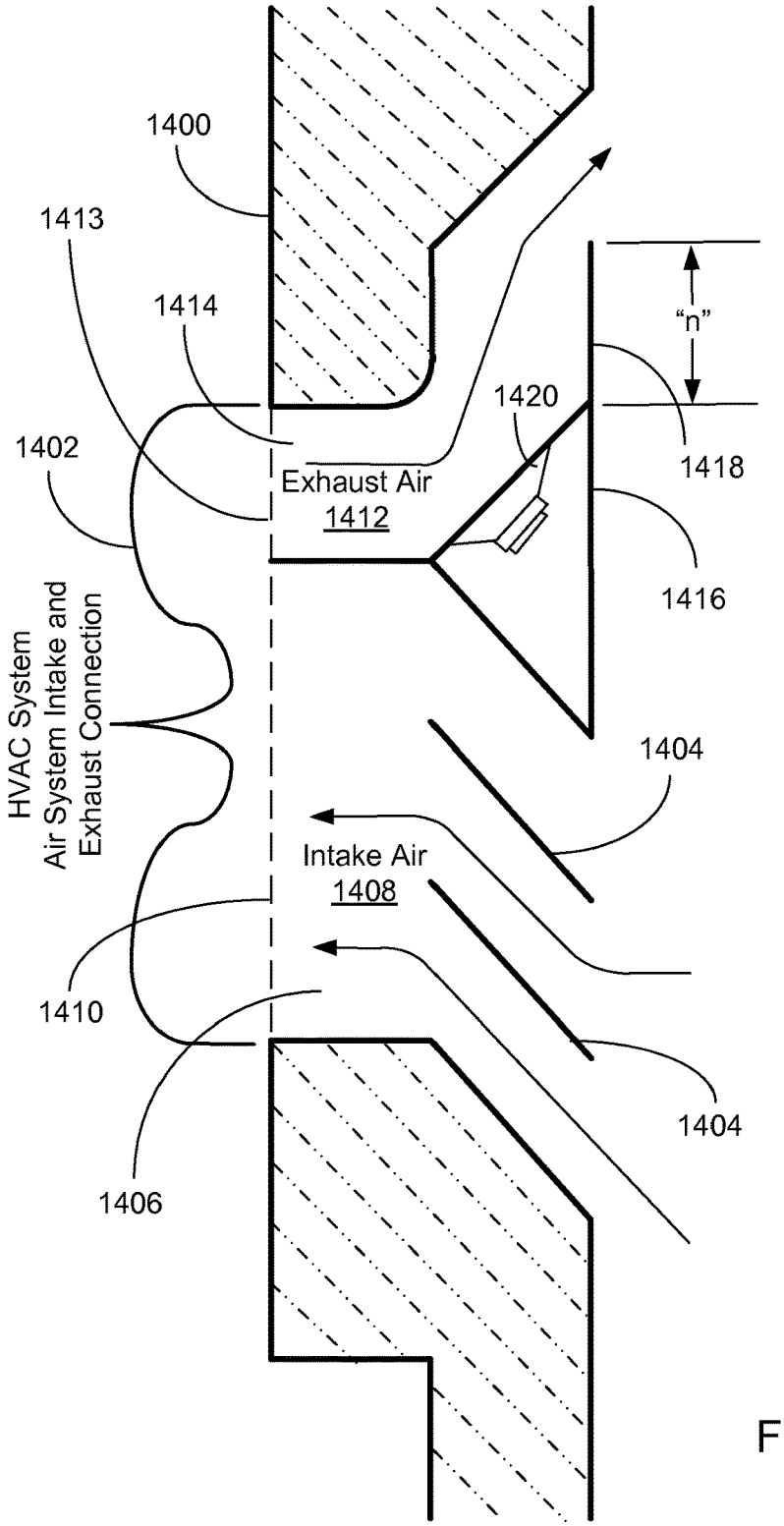
FIG. 14 is a side cut away view of a fifth embodiment of a cross section of an in-wall active noise reduction system built into the wall of a dwelling.

FIG. 14 is a side cut away view of a fifth embodiment of a cross section of an in-wall active noise reduction system built into the wall of a dwelling. The in-wall noise reduction system is positioned within the exterior wall 1400 of the dwelling on one side and the in-wall HVAC system 1402 connected on a second side. A plurality of vanes 1404 are positioned inside a first chamber 1406 within the exterior wall 1400 so that intake air 1408 can be brought into the dwelling and passed to the HVAC's system's intake air vent 1410. Likewise, exhaust air 1412 from the HVAC system's exhaust air vent 1413 can be directed in a second chamber 1414 and directed to the exterior of the dwelling. In such a configuration, the noise generated by the HVAC system 1402 and the noise generated by the air movement can be directed upward and away from the front of the dwelling or the neighbor's dwelling.

In the embodiment shown in FIG. 14, a diverter 1416 is positioned so that the exhaust air 1412 is diverted upwards and away from the intake air 1408. In this embodiment, the vanes 1404 are angled such that the intake air is pulled from a lower point and up into the intake air vent 1410. Also, a spacer 1418 can be positioned on top of the diverter 1416 by a distance n" from the intake air 1408. The distance "n" can be any distance, but typically is long enough so that the exhaust air 1412 is not pulled back into the intake air vent 1410.

In the embodiment of FIG. 14, an active noise cancellation system can also be employed where a microphone detects the noise from the HVAC system and the intake and exhaust air flow. The noise detected is analyzed by a noise cancelation system, typically a digital signal processor and/or computer and a cancellation signal is generated that is sent to at least one transducer 1420 for introducing sound waves to cancel the generated noise. Such an active noise cancellation system will typically not eliminate the noise of the system, but will reduce the sound pressure levels to values that are acceptable.

The HVAC noise and the noise generated by air movement typically creates a white noise environment. An active notice cancellation system may also be employed within the in-wall noise reduction system so that a microphone detects the frequencies of the HVAC noise and the noise generated by the air movement, the noise detected by the microphones is analyzed by a digital signal processor and cancellation frequencies are generated and passed to at least one transducers so that the HVAC noise and noise created by the air movement is cancelled thus reducing the sound pressure levels of the HVAC's operation.

Likewise, passive noise cancellation methodologies can be employed to reduce the sound pressure levels when the HVAC system is in operation by the use of noise absorbing materials such as insulation, sound absorbing materials or creating a muffler system within the noise reduction system.

Figure 15:
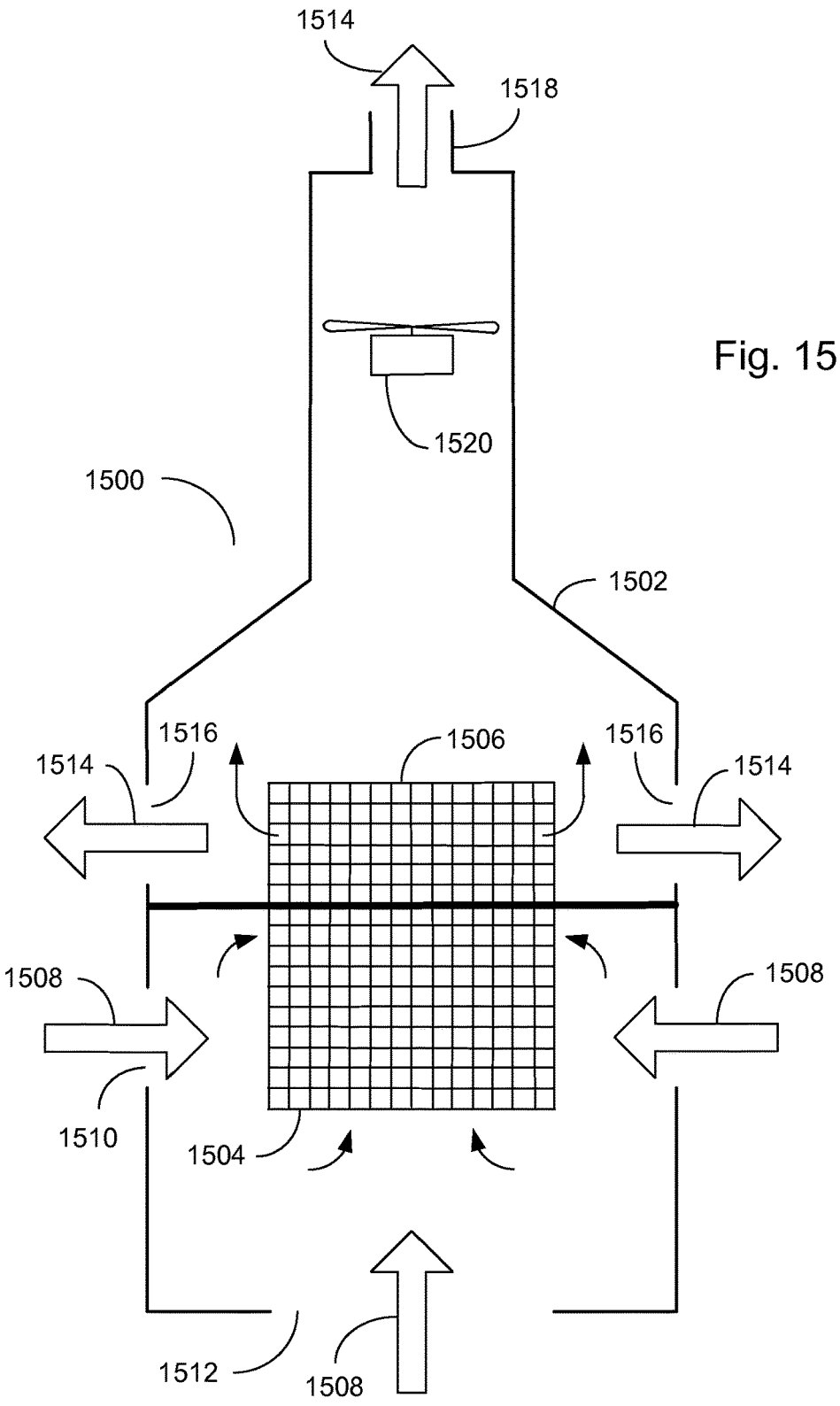
FIG. 15 is a cross sectional view of a chimney structure forming a HVAC noise reduction system.

FIG. 15 is a cross sectional view of a chimney structure forming a HVAC noise reduction system. In this embodiment, the noise reduction system 1500 is disguised as a chimney 1502 and surrounds the intake air vent 1504 and exhaust air vent 1506. The chimney structure can have the intake air 1508 enter the chimney structure 1502 through sides 1510 or from a bottom opening 1512. An alternative opening can be positioned perpendicular (not shown) to the intake air vent 1504.

Likewise, the exhaust air 1514 can exit the chimney structure through one or more openings in the side of the chimney 1516 or through the top of the chimney 1518. For ideal operation, the exhaust air 1514 would be routed out the top of the chimney 1518. However, when venting exhaust air 1514 out the top of the chimney 1518 is not feasible or desirable the exhaust air 1514 may be alternatively vented out the sides of the chimney 1516. An exhaust fan 1520 can be synched with the operation of the HVAC system to turn on and off with the operation of the HVAC system and aids with pushing the exhaust air 1514 out of the top of the chimney 1518. Also, active and passive noise cancellation technologies can be employed to further reduce the noise.

While various embodiments of the invention have been described, it will be apparent to those of ordinary skill in the art that many more embodiments and implementations are possible that are within the scope of this invention.

What is claimed is:

1. A noise reduction system for reducing compressor and fan operational noise radiating from the exhaust of a HVAC system on a building structure's exterior, comprising:

a housing mounted on the exterior of the building structure having a first, second, third and fourth opening and attached to the HVAC system and further comprising:

a first chamber having the first opening for intake air to enter before going through the second opening that provides intake air to the HVAC system;

a second chamber having the third opening for receiving exhaust air from the HVAC system where the exhaust air exits the second chamber through the fourth opening and where the second chamber acts to redirect and reduce the compressor and fan operational noise of the HVAC system on the exterior of the building structure by suppressing and redirecting the compressor and fan operational noise; and where the first opening for the intake air and the fourth opening for the exhaust air are spaced apart so that the first opening does not readily receive the exhaust air from the fourth opening.

2. The noise reduction system for reducing compressor and fan operational noise radiating from the exhaust of a HVAC system on a building structure's exterior of claim 1, where the first and second chamber are positioned adjacent to each other within the housing.

3. The noise reduction system for reducing compressor and fan operational noise radiating from the exhaust of a HVAC system on a building structure's exterior of claim 1, where the second chamber is positioned on top of the first chamber.

4. The noise reduction system for reducing compressor and fan operational noise radiating from the exhaust of a HVAC system on a building structure's exterior of claim 1, further comprising passive noise cancellation materials are constructed into the housing.

5. The noise reduction system for reducing compressor and fan operational noise radiating from the exhaust of a HVAC system on a building structure's exterior claim 1, further comprising passive noise cancellation materials are incorporated into the first chamber.

6. The noise reduction system for reducing compressor and fan operational noise radiating from the exhaust of a HVAC system on a building structure's exterior of claim 1, further comprising passive noise cancellation materials are incorporated into the second chamber.

7. The noise reduction system for reducing compressor and fan operational noise radiating from the exhaust of a HVAC system on a building structure's exterior of claim 1, further comprising active noise cancellation system incorporated into the housing.

8. The noise reduction system for reducing compressor and fan operational noise radiating from the exhaust of a HVAC system on a building structure's exterior of claim 1, further comprising active noise cancellation system incorporated into the first chamber.

9. The noise reduction system for reducing compressor and fan operational noise radiating from the exhaust of a HVAC system on a building structure's exterior of claim 1, further comprising active noise cancellation system incorporated into the second chamber.

10. The noise reduction system for reducing compressor and fan operational noise radiating from the exhaust of a HVAC system on a building structure's exterior of claim 1, where the housing is constructed from wood.

11. The noise reduction system for reducing compressor and fan operational noise radiating from the exhaust of a HVAC system on a building structure's exterior of claim 1, where the housing is constructed from plastic.

12. The noise reduction system for reducing compressor and fan operational noise radiating from the exhaust of a HVAC system on a building structure's exterior of claim 1, where the housing is constructed from metal.

13. The noise reduction system for reducing compressor and fan operational noise radiating from the exhaust of a HVAC system on a building structure's exterior of claim 1, where the housing is constructed from composite wood products.

14. The noise reduction system for reducing compressor and fan operational noise radiating from the exhaust of a HVAC system on a building structure's exterior of claim 1, where the first opening in the first chamber is positioned in a bottom section of the first chamber within the housing.

15. The noise reduction system for reducing compressor and fan operational noise radiating from the exhaust of a HVAC system on a building structure's exterior of claim 1, where the first opening in the first chamber is positioned in a side section of the first chamber within the housing.

16. The noise reduction system for reducing compressor and fan operational noise radiating from the exhaust of a HVAC system on a building structure's exterior of claim 1, where the second opening in the first chamber is positioned in a back section of the first chamber within the housing.

17. The noise reduction system for reducing compressor and fan operational noise radiating from the exhaust of a HVAC system on a building structure's exterior of claim 1, where the third opening in the second chamber is positioned in a side section of the second chamber within the housing.

18. The noise reduction system for reducing compressor and fan operational noise radiating from the exhaust of a HVAC system on a building structure's exterior of claim 1, where the third opening in the second chamber is positioned in a top section of the second chamber within the housing.

19. The noise reduction system for reducing compressor and fan operational noise radiating from the exhaust of a HVAC system on a building structure's exterior of claim 1, where the fourth opening in the second chamber is positioned in a back section of the second chamber within the housing.

20. The noise reduction system for reducing compressor and fan operational noise radiating from the exhaust of a HVAC system on a building structure's exterior of claim 1, where the first and second chamber are formed within an interior of a chimney where the chimney further has a plurality of sides, a bottom and a top.

21. The noise reduction system for reducing compressor and fan operational noise radiating from the exhaust of a HVAC system on a building structure's exterior of claim 20, where the intake air enters the chimney through the chimney bottom.

22. The noise reduction system for reducing compressor and fan operational noise radiating from the exhaust of a HVAC system on a building structure's exterior of claim 20, where the intake air enters the chimney through the plurality of chimney sides.

23. The noise reduction system for reducing compressor and fan operational noise radiating from the exhaust of a HVAC system on a building structure's exterior of claim 20, where the exhaust air exits the chimney through the chimney top.

24. The noise reduction system for reducing compressor and fan operational noise radiating from the exhaust of a HVAC system on a building structure's exterior of claim 20, where the exhaust air exits the chimney through the plurality of chimney sides.

25. The noise reduction system for reducing compressor and fan operational noise radiating from the exhaust of a HVAC system on a building structure's exterior of claim 20, where the exhaust air is assisted by a fan as the exhaust air exits the chimney through the chimney top.

26. The noise reduction system for reducing compressor and fan operational noise radiating from the exhaust of a HVAC system on a building structure's exterior of claim 25, where the fan positioned within the interior of the chimney is synchronized with the HVAC system to turn on and off with the HVAC system's operation.

27. The noise reduction system for reducing compressor and fan operational noise radiating from the exhaust of a HVAC system on a building structure's exterior of claim 20, further comprising passive noise cancellation materials are incorporated into the interior of the chimney.

28. The noise reduction system for reducing compressor and fan operational noise radiating from the exhaust of a HVAC system on a building structure's exterior of claim 20, further comprising an active noise cancellation system incorporated into the interior of the chimney.

29. A noise reduction system for reducing compressor and fan operational noise radiating from the exhaust of a HVAC system on a building structure's exterior, comprising:

a first chamber within a wall of the building structure having a first opening for intake air to enter into before going through a second opening that is positioned to provide intake air for of the HVAC system;

a second chamber within the wall of the building structure having a third opening for receiving exhaust air from the HVAC system and exiting through a fourth opening positioned in the second chamber to decrease the compressor and fan operational noise radiating on the exterior to the building structure; and where the first opening for the intake air and the fourth opening for the exhaust air are spaced apart so that the first opening does not readily receive the exhaust air from the fourth opening.

30. The noise reduction system for reducing compressor and fan operational noise radiating from the exhaust of a HVAC system on a building structure's exterior of claim 29, further comprising at least one vane positioned within the first chamber.

31. The noise reduction system for reducing compressor and fan operational noise radiating from the exhaust of a HVAC system on a building structure's exterior of claim 29, where the first and second chamber are positioned adjacent to each other within the wall.

32. The noise reduction system for reducing compressor and fan operational noise radiating from the exhaust of a HVAC system on a building structure's exterior of claim 29, where the first and second chamber is are positioned on top of the first chamber each other within the wall.

33. The noise reduction system for reducing compressor and fan operational noise radiating from the exhaust of a HVAC system on a building structure's exterior of claim 29, further comprising passive noise cancellation materials are incorporated into the first chamber.

34. The noise reduction system for reducing compressor and fan operational noise radiating from the exhaust of a HVAC system on a building structure's exterior of claim 29, further comprising passive noise cancellation materials are incorporated into the second chamber.

35. The noise reduction system for reducing compressor and fan operational noise radiating from the exhaust of a HVAC system on a building structure's exterior of claim 29, further comprising active noise cancellation system incorporated into the first chamber.

36. The noise reduction system for reducing compressor and fan operational noise radiating from the exhaust of a HVAC system on a building structure's exterior of claim 29, further comprising active noise cancellation system incorporated into the second chamber.

37. The noise reduction system for reducing compressor and fan operational noise radiating from the exhaust of a HVAC system on a building structure's exterior of claim 29, where the first chamber is constructed from wood.

38. The noise reduction system for reducing compressor and fan operational noise radiating from the exhaust of a HVAC system on a building structure's exterior of claim 29, where the first chamber is constructed from plastic.

39. The noise reduction system for reducing compressor and fan operational noise radiating from the exhaust of a HVAC system on a building structure's exterior of claim 29, where the first chamber is constructed from metal.

40. The noise reduction system for reducing compressor and fan operational noise radiating from the exhaust of a HVAC system on a building structure's exterior of claim 29, where the first chamber is constructed from composite wood products.

41. The noise reduction system for reducing compressor and fan operational noise radiating from the exhaust of a HVAC system on a building structure's exterior of claim 29, where the second chamber is constructed from wood.

42. The noise reduction system for reducing compressor and fan operational noise radiating from the exhaust of a HVAC system on a building structure's exterior of claim 29, where the second chamber is constructed from plastic.

43. The noise reduction system for reducing compressor and fan operational noise radiating from the exhaust of a HVAC system on a building structure's exterior of claim 29, where the second chamber is constructed from metal.

44. The noise reduction system for reducing compressor and fan operational noise radiating from the exhaust of a HVAC system on a building structure's exterior of claim 29, where the second chamber is constructed from composite wood products.

* * * * *